US006705093B1

(12) United States Patent
Taras et al.

(10) Patent No.: US 6,705,093 B1
(45) Date of Patent: Mar. 16, 2004

(54) HUMIDITY CONTROL METHOD AND SCHEME FOR VAPOR COMPRESSION SYSTEM WITH MULTIPLE CIRCUITS

(75) Inventors: Michael F. Taras, Fayetteville, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/260,057

(22) Filed: Sep. 27, 2002

(51) Int. Cl.[7] ..... F25B 27/00; F25D 17/06
(52) U.S. Cl. ..... 62/90; 62/238.6
(58) Field of Search ..... 62/90, 173, 238.6

(56) References Cited

U.S. PATENT DOCUMENTS 3,402,564 A * 9/1968 Nussbaum ..... 62/173
5,099,651 A * 3/1992 Fischer ..... 62/79
6,055,818 A * 5/2000 Valle et al. ..... 62/173

* cited by examiner

*Primary Examiner*—Melvin Jones
(74) *Attorney, Agent, or Firm*—Bachman & LaPointe

(57) ABSTRACT

A vapor compression system includes a first circuit having a first compressor and a first condenser; a second circuit having a second compressor and a second condenser; an evaporator communicated with the first circuit and the second circuit for cooling a stream of air to provide a cooled air stream; and an air reheat circuit communicated with the cooled air stream and one circuit of the first circuit and the second circuit for exposing the cooled air stream to heat transfer interaction with refrigerant from the one circuit to control humidity of the air stream. Humidity control is provided in a cost-effective manner, reducing system complexity, improving part- and full-load performance, extending operating range, and enhancing reliability.

10 Claims, 3 Drawing Sheets

HUMIDITY CONTROL METHOD AND SCHEME FOR VAPOR COMPRESSION SYSTEM WITH MULTIPLE CIRCUITS

BACKGROUND OF THE INVENTION

The invention relates to vapor compression systems and, more particularly, to a vapor compression system with multiple circuits having humidity control.

Vapor compression systems are widely used in air-conditioning, chilling and refrigeration applications, and humidity control in such units is frequently an important concern.

In some instances, multiple circuit vapor compression systems are provided and, in such systems, the equipment utilized to provide humidity control must be duplicated as many times as there are circuits in the system. This leads to increased complexity and cost of the system.

It is therefore the primary object of the present invention to provide simplified and more efficient humidity control in multiple circuit vapor compression systems.

Other objects and advantages of the present invention will appear hereinbelow.

SUMMARY OF THE INVENTION

In accordance with the present invention, the foregoing objects and advantages have been readily attained.

According to the invention, a vapor compression system is provided which comprises a first circuit having a first compressor and a first condenser; a second circuit having a second compressor and a second condenser; an evaporator communicated with said first circuit and said second circuit for cooling a stream of air to provide a cooled air stream; and an air reheat circuit communicated with said cooled air stream and one circuit of said first circuit and said second circuit for exposing said cooled air stream to heat transfer interaction with refrigerant from said one circuit.

BRIEF DESCRIPTION OF THE DRAWINGS

A detailed description of preferred embodiments of the present invention follows, with reference to the attached drawings, wherein.

DETAILED DESCRIPTION

The invention relates to vapor compression systems having multiple circuits wherein humidity control is provided in the form of an air reheat circuit which allows for re-heating of over-cooled air from the system evaporator, thus allowing air to be cooled beyond a desired temperature for enhanced moisture removal, and then re-heated to a desired temperature. In accordance with the present invention, and advantageously, the air reheat circuit is communicated with only a single circuit of the multiple circuit system, and serves to reheat the entire stream of air coming from the evaporator so as to provide for humidity control in an efficient and cost-effective manner, and further in a manner which allows for more continuous operation of the system, thereby avoiding frequent starts and stops which can lead to premature system failure. Moreover, overall system part- and full-load performance is improved, and system operating range is extended.

Figure 1:
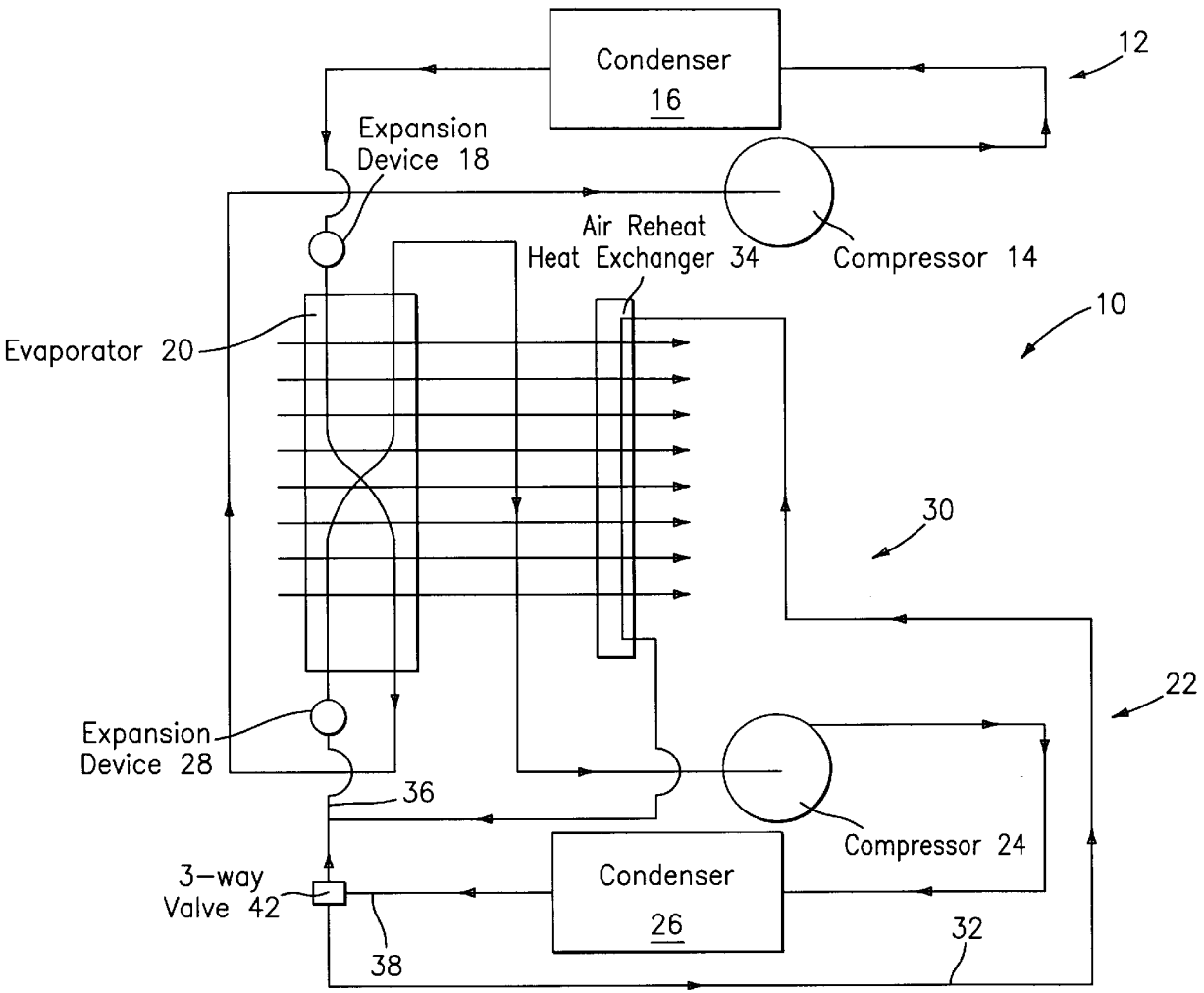
FIG. 1 schematically illustrates one embodiment of a vapor compression system in accordance with the present invention.

Turning now to FIG. 1, a system 10 in accordance with the present invention is illustrated. System 10 includes a first circuit 12 including a first compressor 14, a first condenser 16 and first expansion device 18. These components are connected by refrigerant lines such that refrigerant passes from compressor 14 to condenser 16, from condenser 16 to expansion device 18, and from expansion device 18 to an evaporator 20 which is preferably adapted to serve all circuits of the system.

It should be understood that evaporator 20 does not need to be a single unit as shown, and can instead be several units.

From evaporator 20, refrigerant flows back to compressor 14, and refrigerant is processed along this circuit as is well known to a person of ordinary skill in the art so as to provide the desired cooling of air through evaporator 20 for generating a cooled air stream into a conditioned space.

In further accordance with the present invention, a second circuit 22 is also provided and includes a second compressor 24, a second condenser 26, a second expansion device 28 and refrigerant lines communicating same so that refrigerant flows from compressor 24 to condenser 26, from condenser 26 to expansion device 28, from expansion device 28 to evaporator 20, and from evaporator 20 back to second compressor 24 as desired.

In still further accordance with the present invention, system 10 is provided with an air reheat circuit generally indicated at 30, which in this embodiment includes a refrigerant line 32 communicated with second circuit 22 and passing through an air reheat heat exchanger 34, and from heat exchanger 34 back to refrigerant line 36 for feed through expansion device 28 to evaporator 20. Air reheat circuit 30 advantageously serves to convey warm refrigerant liquid from condenser 26 to heat exchanger 34 for reheating of air as desired.

Figure 3:
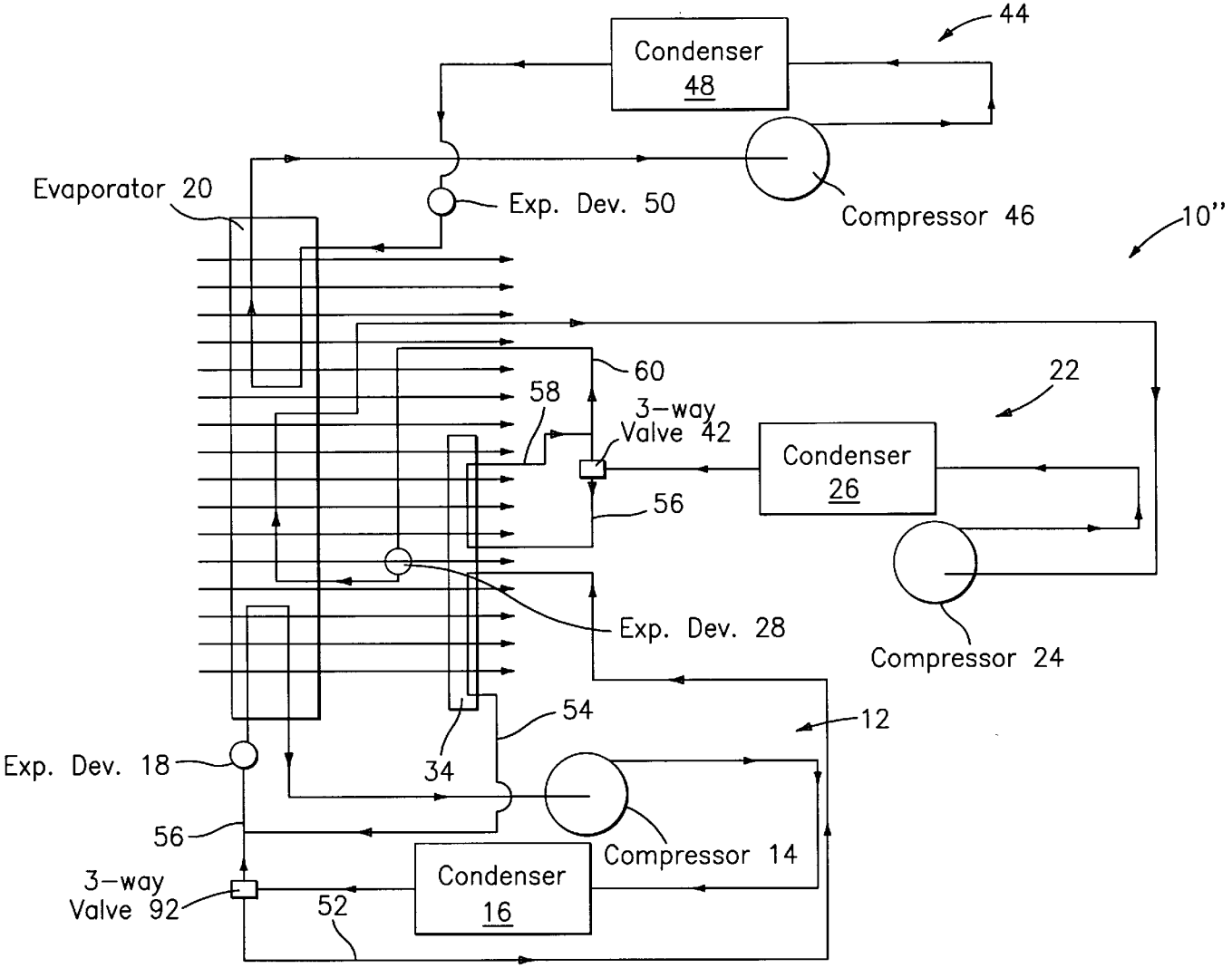
FIG. 3 schematically illustrates a further alternative embodiment of a vapor compression system in accordance with the present invention incorporating three compressor circuits and two air reheat circuits.

It should be appreciated that although the drawings show air reheat heat exchanger 34 extending across the entire stream of evaporator air, it may be desirable, and it is considered well within the scope of the present invention, to provide for reheat of only a portion of the evaporator air stream if desired, and such a configuration is illustrated in FIG. 3 discussed below.

In accordance with the present invention, air passing through evaporator 20 is cooled beyond a desired temperature, advantageously to a temperature selected to remove moisture or humidity from the air stream at a desired rate, so as to provide an over-cooled air stream which is then exposed to air reheat heat exchanger 34 as desired. Refrigerant flowing through air reheat circuit 30 advantageously re-heats the cooled air back to the desired temperature, thereby maintaining the desired temperature of air while nevertheless allowing for humidity control.

It is particularly advantageous in accordance with the present invention that a single air reheat circuit 30 is provided for treating the entire flow of air through evaporator 20, and this circuit is communicated with refrigerant only from second circuit 22. Of course, in embodiments having a plurality of evaporators, air reheat circuit 30 can be used to treat flow of air through all of them.

In accordance with the present invention, air reheat circuit 30 is preferably communicated with the circuit of the overall system which is last to unload in a partial load operation. In this manner, the humidity control function is continuously provided regardless of the level of load on the system. Further, the system typically will have different discharge pressures for each circuit due to various factors including non-uniform air flow, uneven heat exchanger surface split and the like. In accordance with the present invention, air reheat circuit 30 is advantageously communicated with the circuit having the highest discharge pressure in a conventional cooling mode of operation.

By communicating single air reheat circuit 30 with the circuit which has the highest discharge pressure, the discharge pressure in this circuit is reduced due to extra cooling obtained by heat transfer interaction in heat exchanger 34, thereby increasing high ambient operation limit and providing more efficient arrangement and reduction in a number of start-stop cycles, and benefiting overall system full-load and part-load efficiency as well.

Figure 2:
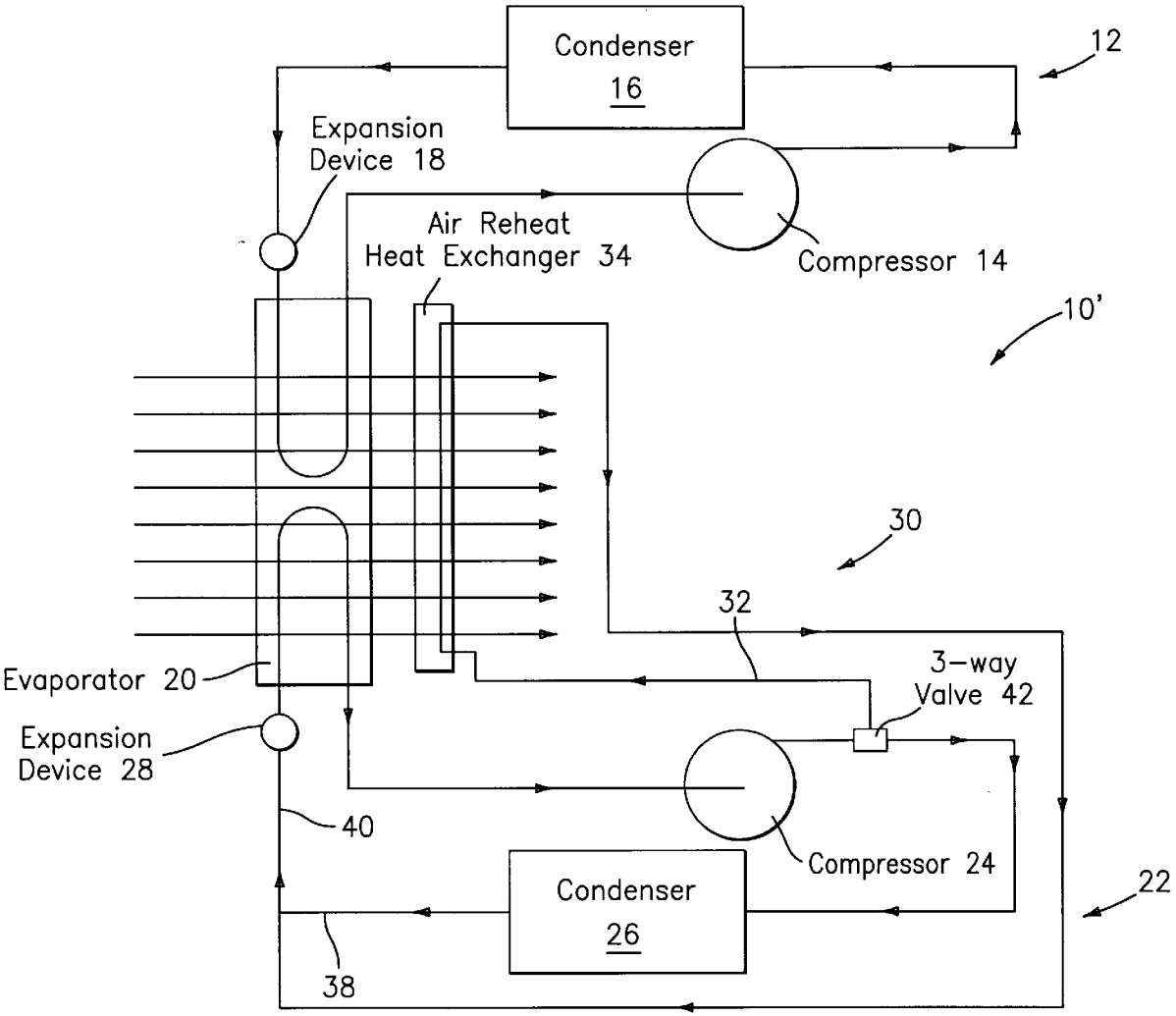
FIG. 2 schematically illustrates an alternative embodiment of a vapor compression system in accordance with the present invention.

Turning now to FIG. 2, a further embodiment of the present invention is illustrated. FIG. 2 shows a system 10' in accordance with the present invention having a first circuit 12 including first compressor 14, first condenser 16 and first expansion device 18. These components are connected by refrigerant lines which flow from compressor 14 to condenser 16, from condenser 16 to expansion device 18, from expansion device 18 to evaporator 20 which serves both circuits of system 10' as described above, and from evaporator 20 back to compressor 14.

System 10' also includes a second circuit 22 including second compressor 24, second condenser 26 and second expansion device 28 which are communicated by refrigerant lines such that refrigerant flows from compressor 24 to condenser 26, from condenser 26 to expansion device 28, from expansion device 28 to evaporator 20, and from evaporator 20 back to compressor 24.

As in the embodiment of FIG. 1, system 10' in accordance with the present invention also has an air reheat circuit 30. In this embodiment, however, air reheat circuit 30 flows from a discharge of compressor 24 through a heat exchanger 34, such as an air reheat coil, and back to a line 40 for feeding evaporator 20 through expansion device 28 as desired. In similar fashion to the embodiment of FIG. 1, refrigerant in air reheat circuit 30, in this case, in a gaseous state, is exposed to cold air from evaporator 20 and advantageously serves to warm this air or reheat this air to a desired temperature.

It should also be noted that in this embodiment, evaporator 20 is operated on one side in communication with first circuit 12, and operated on the other side in communication with second circuit 22. This is called a face-split configuration. In the embodiment of FIG. 1, refrigerant lines from first and second circuits 12, 22 cross so that both extend along the entire length of evaporator 20. This is called an intertwined configuration. Evaporator 20 can also be a row-split configuration (not shown) which is similar to the intertwined configuration in that the refrigerant lines extend the entire length of the evaporator, but are not crossed as shown in the FIG. 1. Of course, other types of evaporators could be used as well, well within the scope of the present invention.

It should be appreciated that although FIGS. 1 and 2 show two-circuit embodiments of the present invention, the teachings of the present invention can readily be incorporated into systems having three or more circuits, wherein some number less than the total number of circuits are communicated with air-reheat circuits as described in connection with the embodiments of FIGS. 1 and 2. Such an embodiment is illustrated in FIG. 3.

FIG. 3 shows an embodiment of a system 10" including three compressor circuits and two air reheat circuits. FIG. 3 shows first circuit 12 including compressor 14, condenser 16, expansion device 18 and evaporator 20. Second circuit 22 includes compressor 24, condenser 26, expansion device 28 and evaporator 20, while third circuit 44 includes compressor 46, condenser 48, expansion device 50 and evaporator 20. In this embodiment, two air reheat circuits are incorporated, one communicated with circuit 12 and another communicated with circuit 22. As shown in FIG. 3, the air reheat circuit communicated with circuit 12 is defined by a refrigerant line 52 extending from 3-way valve 42 and passing through a portion of air reheat heat exchanger 34 as shown. Discharge from this portion of air reheat heat exchanger 34 then passes through discharge line 54 and to main refrigerant line 56 for feeding expansion device 18.

The air reheat circuit communicated with circuit 22 includes a refrigerant line 56 extending from 3-way valve 42 of circuit 22, and passing through another portion of air reheat heat exchanger 34, with a discharge line 58 from air reheat heat exchanger rejoining refrigerant line 60 for feed to expansion device 28 and evaporator 20.

It should be noted that the embodiment of FIG. 3 shows the configuration of the present invention wherein the air reheat circuits draw refrigerant downstream of the condenser. This configuration of more than two refrigerant circuits and more than one air reheat circuits could of course be incorporated into configurations wherein refrigerant is drawn from compressor discharge as well.

It should also be noted that in this embodiment, air reheat heat exchanger 34 is positioned so as to reheat only a portion of air passing through evaporator 20.

A configuration as illustrated in FIG. 3, with more than two refrigerant circuits and more than one air reheat circuit, advantageously provides for further flexibility in humidity control, additional configurations for unloading, and increased system redundancy, all as desired in accordance with the present invention.

FIGS. 1 and 2 show air reheat circuit 30 drawing refrigerant from the main refrigerant line through a 3-way valve 42 which can advantageously be a 3-way shutoff device for use in switching 100% of the refrigerant flow between conventional cooling mode and humidity control mode of operation. Alternatively, 3-way valve 42 can be provided as a regulating device for gradually controlling refrigerant flow between conventional cooling and dehumidification modes of operation.

Furthermore, as occupied space load changes over time, full cooling capacity is not required through the complete equipment life cycle. Under such circumstances, some circuits of conventional systems are shut down, thereby increasing the number of start/stop compressor cycles, and thereby potentially reducing compressor reliability. In accordance with the present invention, and particularly at low load operation, one or more circuits of the plurality of circuits can be completely dedicated to the air reheat humidity control function and thereby substantially improve compressor reliability while having nominal affect on system performance.

Finally, it should be readily appreciated that the system in accordance with the present invention advantageously provides vapor compression systems having multiple circuits wherein humidity control is provided in an inexpensive and efficient manner.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vapor compression system, comprising:

a first circuit having a first compressor and a first condenser;

a second circuit having a second compressor and a second condenser;

an evaporator communicated with said first circuit and said second circuit for cooling a stream of air to provide a cooled air stream; and an air reheat circuit communicated with said cooled air stream and one circuit of said first circuit and said second circuit for exposing said cooled air stream to heat transfer interaction with refrigerant from said one circuit.

2. The system of claim 1, wherein said air reheat circuit further comprises a heat exchanger for exposing said cooled air stream to said refrigerant.

3. The system of claim 2, wherein said air reheat circuit comprises a reheat refrigerant line extending from a condenser discharge line of said one circuit to said heat exchanger and from said heat exchanger to an evaporator inlet of said one circuit.

4. The system of claim 2, wherein said air reheat circuit comprises a reheat refrigerant line extending from a compressor discharge line from said one circuit to said heat exchanger and from said heat exchanger to a condenser discharge line of said one circuit.

5. The system of claim 1, wherein said one circuit is adapted to unload after the other circuit of said first circuit and said second circuit when said system is operating at a part load.

6. The system of claim 1, wherein said one circuit has a higher discharge pressure than the other of said first circuit and said second circuit.

7. The system of claim 1, wherein said evaporator is a single evaporator unit.

8. The system of claim 1, wherein said evaporator comprises at least a first evaporator unit communicated with said first circuit and a second evaporator unit communicated with said second circuit, and wherein said air reheat circuit is communicated said cooled air stream from each of said first evaporator unit and said second evaporator unit.

9. The system of claim 1, further comprising at least one additional circuit having an additional compressor and an additional condenser, and wherein said air reheat circuit is communicated with said cooled air stream and one circuit of said first circuit, said second circuit and said at least one additional circuit.

10. The system of claim 9, further comprising at least one addition air reheat circuit communicated with another circuit of said first circuit, said second circuit and said at least one additional circuit.

* * * * *